United States Patent [19]

Doss

[11] Patent Number: 4,694,712

[45] Date of Patent: Sep. 22, 1987

[54] WELL STRING SECTION SPINNING TOOL

[76] Inventor: Hubert M. Doss, 803 N. Madison St., Magnolia, Ark. 71753

[21] Appl. No.: 780,674

[22] Filed: Sep. 26, 1985

[51] Int. Cl.[4] ..... B25B 21/00

[52] U.S. Cl. ..... 81/57.17; 81/57.2; 81/57.14

[58] Field of Search ..... 81/57.17, 57.19, 57.2, 81/57.14, 57.3, 57.33

[56] References Cited

U.S. PATENT DOCUMENTS

| | | | |
|---|---|---|---|
| 2,862,690 | 12/1958 | Mason | 81/57.17 |
| 3,799,010 | 3/1974 | Guier | 81/57.17 |
| 4,079,640 | 3/1978 | Golden | 81/57.17 |
| 4,471,674 | 9/1984 | Doss | 81/57.17 |
| 4,512,216 | 4/1985 | Callegari et al. | 81/57.17 |

FOREIGN PATENT DOCUMENTS

| | | | |
|---|---|---|---|
| 480401 | 1/1952 | Canada | 81/57.17 |

*Primary Examiner*—Frederick R. Schmidt
*Assistant Examiner*—Bradley I. Vaught
*Attorney, Agent, or Firm*—Harvey B. Jacobson

[57] ABSTRACT

A body is provided including a first end defining a vertically extending outwardly opening notch therein and at least one door is pivotally mounted from a corresponding side of the body end for swinging between a closed position across the body end and an open position extending outwardly from the body end. A motor driven drum is jouralled within the body on the side of the notch away from the direction in which the notch opens and an endless flexible drive members includes a positive bright passing about the drum. The free swinging end of the door has a roller journalled therefrom and the side of the first end of the body across which the door extends has a guide roller journalled therefrom, the rollers generally paralleling the drum. The elongated flexible drive member includes position bights passing about the guide rollers and an inverse or negative bight disposed within the notch and adapted to extend about an elongated member extending lengthwise through the notch and adapted to be turned by the drive member, the inverse or negative bight of the drive member opening outwardly between the guide rollers in a direction inclined at least 45° relative to the direction in which the notch opens.

10 Claims, 5 Drawing Figures

WELL STRING SECTION SPINNING TOOL

BACKGROUND OF THE INVENTION

1. Field of the Invention

The instant invention relates to a well string section spinning tool incorporating a pair of endless well string section engaging drive belts each including a positive bight extending about and frictionally engaged by at least approximately 180° of the outer peripery of a drive wheel or drum and with each drive belt further passing about three guide rollers arranged relative to the well string section to be spun such that an inverse or negative bight of each drive belt extends about and frictionally engages at least 270° and less than 360° of the outer periphery of the well string section and with the 270° peripheral areas of the well string section engaged by the inverse bights of the belts overlapping each other by at least generally 90°. By such engagement of a well string section to be spun throughout the equivalent of 540° of the outer periphery of the well string section rotary torque applied to the well string section through the drive belts may be dramatically increased above the usual drive torque transferable from drive belts to a well string section to be spun, this being extremely important when drive belts as opposed to drive chains are used to prevent the outer surfaces of a metallic well string section from being marred and when relatively fragile fiberglass or similar other than metallic well strung sections are to be spun.

2. Description of the Related Art

Well string spinning tools including some of the general structural and operational features of the instant invention are disclosed in my prior U.S. Pat. No. 4,471,674 and in U.S. Pat. No. 4,512,216. In addition, other similar well string section spinning tools are disclosed n U.S. Pat. Nos. 870,014, 1,105,854, 1,925,970, 2,365,839, 2,487,987, 2,523,159, 2,690,689, 2,746,329, 2,862,690, 4,099,429 and 4,099,430.

However, these prior patents do not disclose well string section spinning tools including the increased drive belt-to-well string section torque transfering capacity of the well string section spinning tool of the instant invention.

SUMMARY OF THE INVENTION

The well string section spinning tool of the instant invention includes a first form incorporating a pair of torque transfer drive belts each incorporating an inverse bight extending about a well string section to be spun and wherein the inverse bights open in directions relatively angulated more than 90°. In addition, the two inverse bights of the first form of the invention each contact the well string section to be spun throughout at least generally 270° of the outer periphery of the well string section and with the 270° areas of contact of the belts with the pipe overlapping at least generally 90°.

A second form of the invention utilizes only a single belt including an inverse bight engaging the periphery of the well string section to be spun throughout at least generally 270° and less than 360° of the periphery of the well string section. Further, both forms of the invention incorporate a body having opposite sides and an outwardly opening notch formed in one side to be advanced toward and away from a well string section to be spun and wherein the inverse torque transfer belt bight(s) opens in a direction angularly displaced at least 45° relative to the direction in which the aforementioned notch opens. Still further, the inverse bight of the torque transfer belt engaged with the pipe string section to be spun is defined, at least in part, by a guide wheel carried by the free end portion of an elongated closure jaw extending across the open end of the notch in a direction disposed at generally 90° relative to the direction in which the notch opens and with the opposite base end of the jaw being pivotally mounted from the body on the side of the notch remote from the side thereof upon which the guide wheel is disposed when the jaw is closed. In that form of the invention utilizing a pair of torque transfer belts, a closure jaw is provided for each of the two torque transfer belts and the two jaws open in opposite directions from closed portions extending across the aforementioned notch.

The main object of this invention is to provide a well string section spinning tool utilizing one or more belts for the purpose of transferring rotary torque to a well string section to be spun and to thereby eliminate marring of the exterior of the well string section as is usually associated with torque transfer chains provided on some spinning tools.

Another object of this invention is to provide a torque transfer belt equipped spinning tool constructed in a manner whereby each torque transfer belt (one or more) includes an inverse bight engaged with the well string section to be spun throughout at least generally 270° and less than 360° of the outer periphery of the well string section.

Another important object of this invention is to provide a spinning tool utilizing a pair of torque transfer belts with the 270° contact areas of the two belts with the pipe section to be spun overlapping about the periphery of the pipe section at least generally 90°.

Still another important object of this invention is to provide a well string section spinning tool utilizing a pair of torque transfer belts each including an inverse bight engaged with the well string section to be spun and with the two inverse bights opening in directions angulated more than 90° relative to each other.

A further important object of this invention is to provide torque transfer belt equipped well string section spinning tool defining an outwardly opening notch in which to receive the well string section to be spun and including an elongated closure door swingable into a closed position extending across the open end of the notch at generally 90° relative to the direction in which the notch opens and with the free swinging end of the door including guide wheel or roller means which forms, in part, the inverse bight of the torque transfer belt engaged about the well spring section disposed in the notch and to be spun.

A final object of this invention to be specifically enumerated herein is to provide a well string section spinning tool in accordance with the preceeding objects and which will conform conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
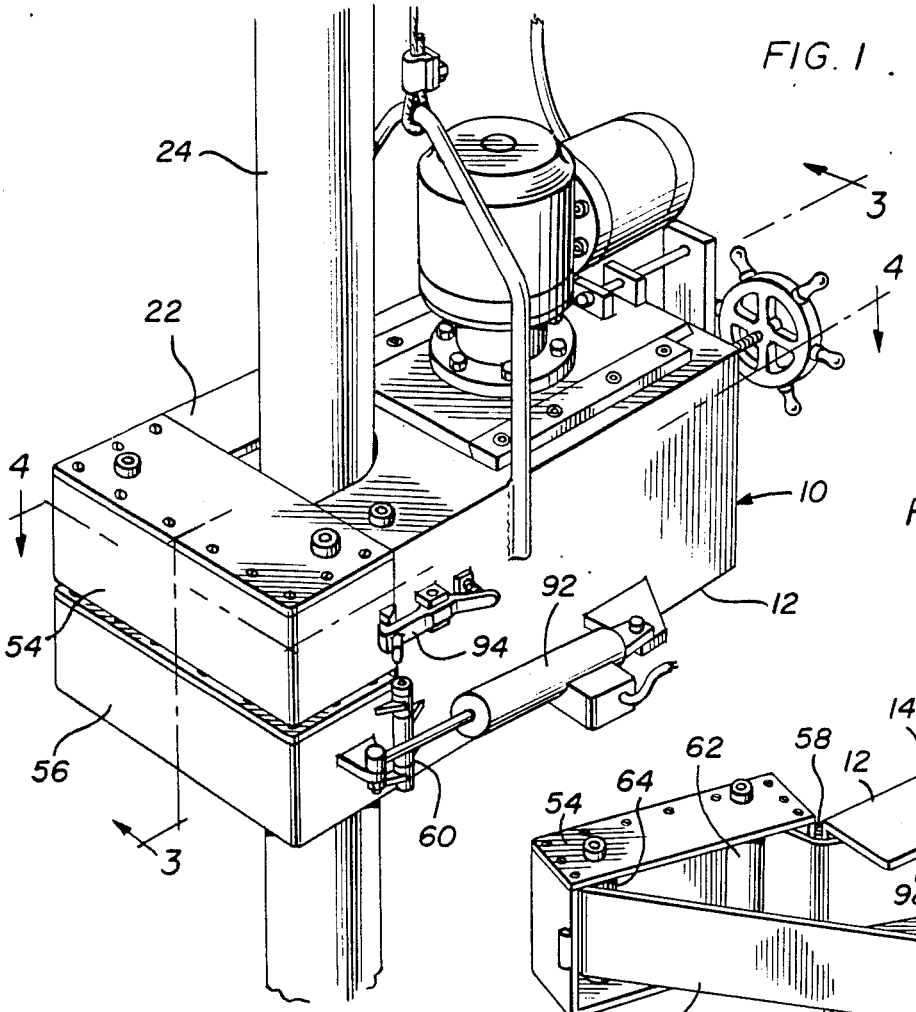
FIG. 1 is a perspective view of a first form of the well string section spinning tool of the instant invention with a well string section to be spun operatively associated with the tool.
Figure 2:
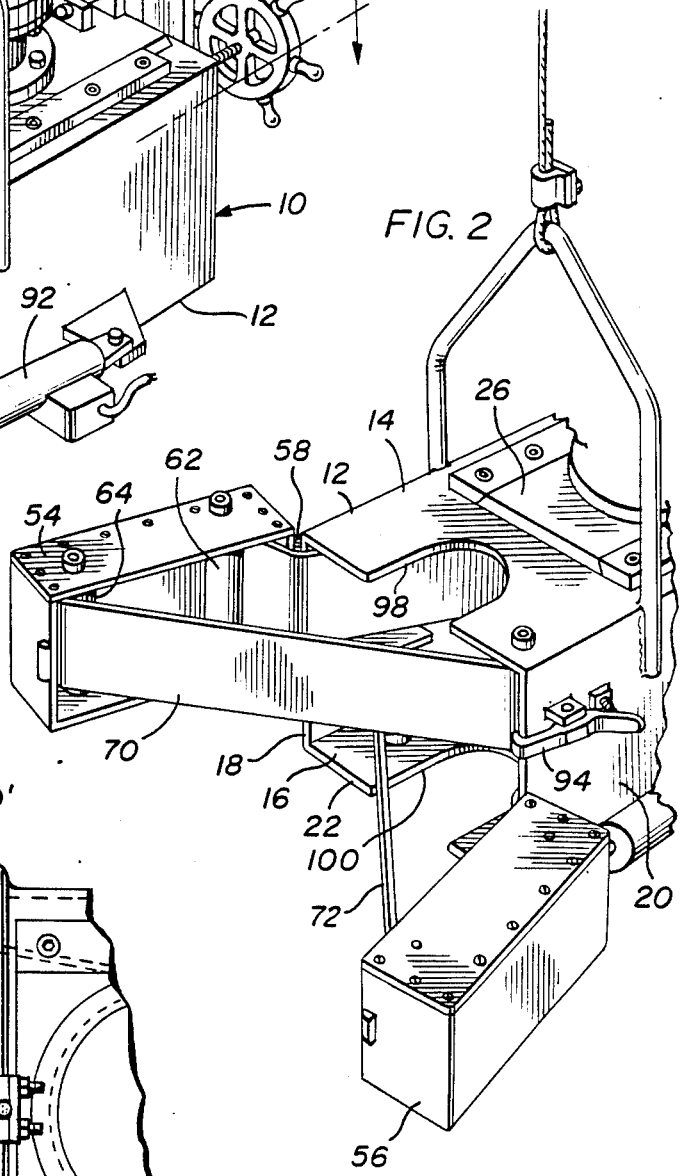
FIG. 2 is a fragmentary perspective view of the tool with the jaws thereof in open positions.

Referring now more specifically to the drawings, the numeral 10 generally designates the well string section spinning tool of the instant invention. The tool 10 includes a hollow elongated body 12 including top and bottom walls 14 and 16 interconnected by upstanding opposite sidewalls 18 and 20. The body 12 includes a first open end 22 which may be advanced toward and away from a well string section 24 to be spun by the tool 10.

Top and bottom mounting plates 26 and 28 are guidingly supported from the top and bottom walls 14 and 16 for shifting longitudinally of the latter and rotatably journal the upper and lower ends of a vertical torque output shaft 30 therefrom. The torque output shaft 30 comprises the power output shaft of a gear reduction motor assembly referred to in general by the reference numeral 32 mounted from the top mounting plate 26 and the end of the body 12 remote from the open end 22 thereof is closed by an end wall 34 and the latter rotatably journals a jack screw 36 therefrom against axial shifting relative thereto and with the jack screw 36 projecting outwardly of the wall 34. The outer end of the jack screw 36 has a hand wheel 38 mounted thereon and a pressure plate 40 threadingly receives the jack shaft 36 therethrough as at 42. The pressure plate 40 includes upper and lower ends from which corresponding ends of a pair of thrust shafts 44 are supported and the thrust shafts 44 are slidingly received through stationary guides 46 and 48 supported from the top and bottom walls 14 and 16 and having their forward ends remote form the pressure plate 40 anchored relative to anchor tabs 50 and 52 carried by the mounting plates 26 and 28. Accordingly, the shaft 30 may be shifted toward and away from the open end 22 of the body 12 by turning the hand wheel 38.

The open end 22 of the body 12 includes a pair of upper and lower closure jaws or doors 54 and 56 pivotally mounted from the side walls 18 and 20 as at 58 and 60. Each of the jaws or doors 54 and 56 is swingable between an open position projecting outwardly of the open end 22 and a closed position extending transversely across the open end 22.

The jaws 54 and 56 are hollow and each journals a pair of internal rollers 62 and 64 therefrom with the rollers 62 and 64 being mounted from the base and free ends, repectively, of the jaws or doors 54 and 56.

The shaft 30 has a pair of upper and lower drive drums 66 and 68 mounted thereon for rotation therewith and a pair of torque transfer or drive belts 70 and 72 are trained about the drive drums 66 and 68 and a corresponding pair of the rollers 62 and 64. Each of the belts 70 and 72 includes positive bights 74 and 76 extending about the corresponding rollers 62 and 64, a third positive bight 78 extending about the corresponding drum and an inverse or negative bight 80 extending about the wall string section to be spun, see FIG. 4. In addition, the body 12 includes opposite side rollers 82 and 84 about which the belts 70 and 72 extend by further positive bights 86 and 88.

The jaws or doors 54 and 56 are opened and closed through the utilization of fluid cylinders 90 and 92 and releasably latched in the closed positions by latches 94 and 96. The top and bottom walls 14 and 16 include vertically registered notches 98 and 100 formed therein and opening outwardly of the open end 22 of the body 12 and the jaws or doors 54 and 56 are swingably into closed positions such as that illustrated in FIG. 1 of the drawings closing the outer ends of the notches 98 and 100.

Figure 4:
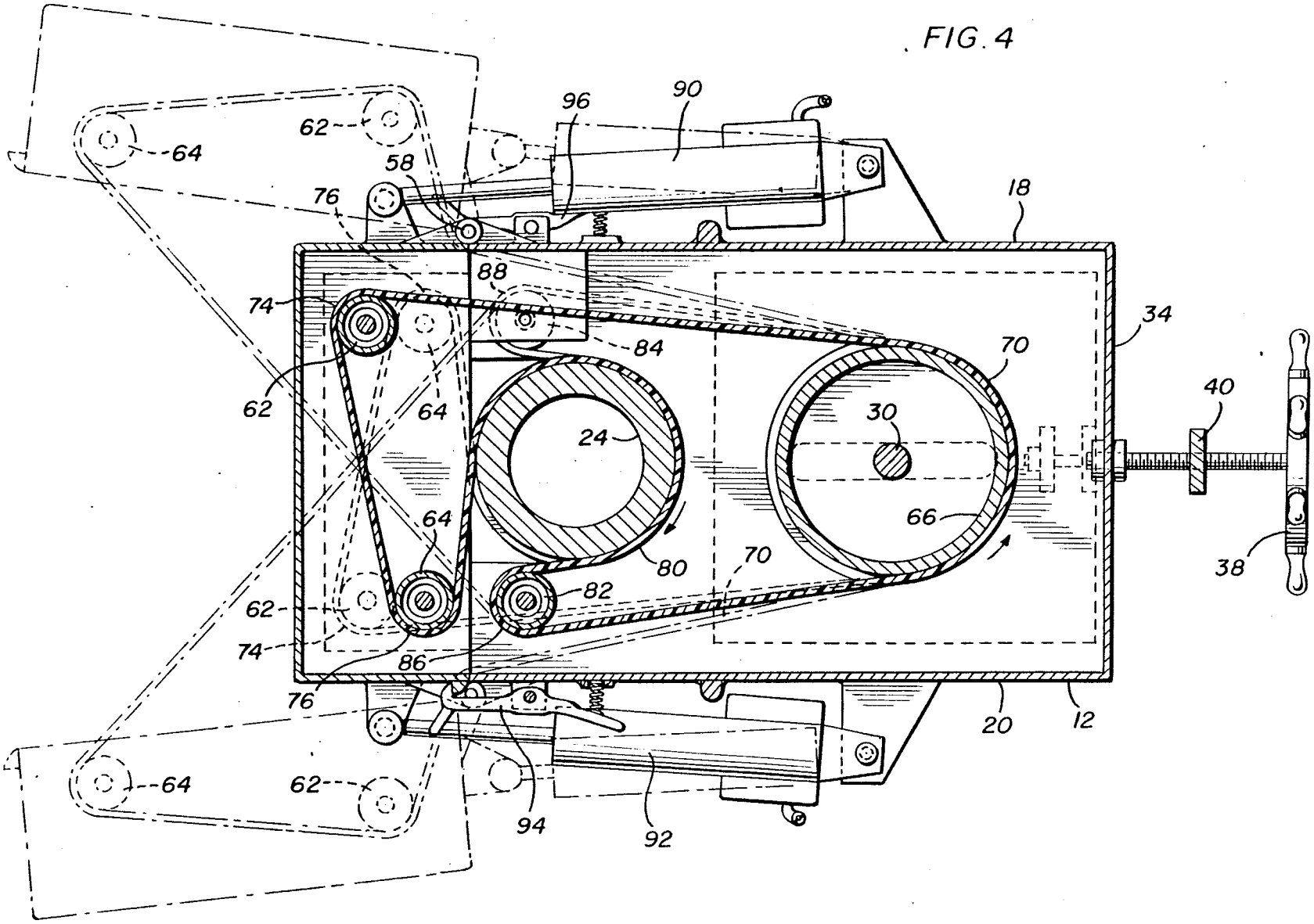
FIG. 4 is an enlarged horizontal section view taken substantially upon the plane indicated by the section line 4—4 of FIG. 1.

Form FIG. 4 of the drawings, it may be seen that the rollers 64 an 82 about which the belt 70 is trained are arranged, when the door or jaw 54 is in the closed position, in such a manner that the bight 80 of the belt 70 disposed about the well string section 24 received in the notches 98 and 100 extends about the section 24 throughout at least generally 270° and less than 360° of the outer periphery of the section 74. This also applies to the bight 80 of the belt 72. Further, from FIG. 4 of the drawings it may be seen that the inverse bights 80 of the belts 70 and 72 disposed about the section 24 open in directions which are relatively angulated at least approximately 90° about the center axis of the section 24 and therefore at least substantially 180° of the outer peripery of the section 24 is engaged by both belts 70 and 72 with each belt engaged with the same approximately 90° angular extent of the section 24 which is not engaged by the inverse bight of the other belt.

With conventional well string section spinning tools such as those disclosed in U.S. Pat. Nos. 4,471,674 and 4,512,216, the jaws or doors provided corresponding to the jaws or doors 54 and 56 do not extend across the equivalent of the notches 98 and 100 of the instant invention from one side thereof to the other. With applicant's invention contact rollers such as those provided at 74 in U.S. patent Nos. 4,471,674 and at 15*a* and 15*b* in U.S. Pat. No. 4,512,216 are not required. This is because the bights 80 open in directions which are angularly displaced approximately 90° relative to each other. Because of this relationship the belts themselves serve to maintain the section 24 within the notches 98 and 100. It is extremely important that such well string section engaging rollers or wheels not be necessary when the well string section to be spun is constructed of fiberglass.

Of course, hand wheel 38 is provide to enable the belts 70 and 72 to be tensioned, as desired, and automatic controls and actuators may be provided for the cylinders 90 and 92 as well as the latches 94 and 96 if desired. Also, a remotely operable actuator may be provided in lieu of the hand wheel 38.

Figure 5:
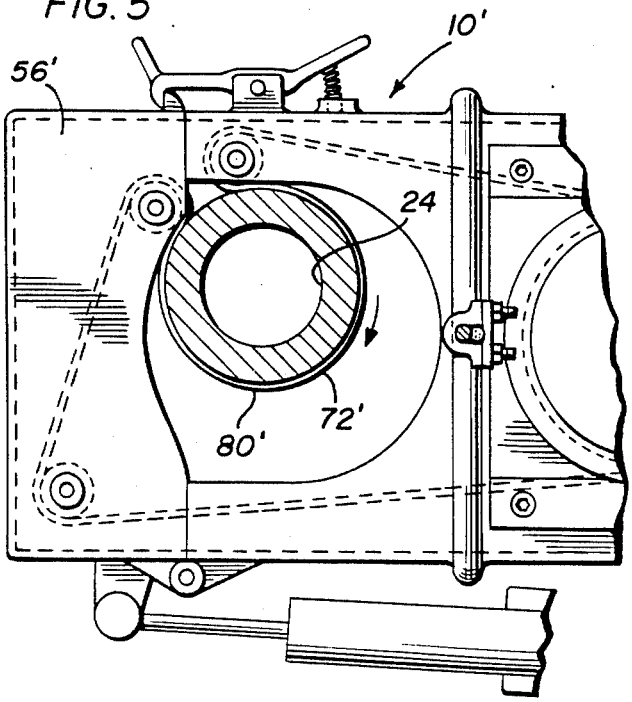
FIG. 5 is a fragmentary enlarged top plan view of a modified form of spinning tool utilizing only one torque transfer belt and a single closure jaw.
Figure 3:
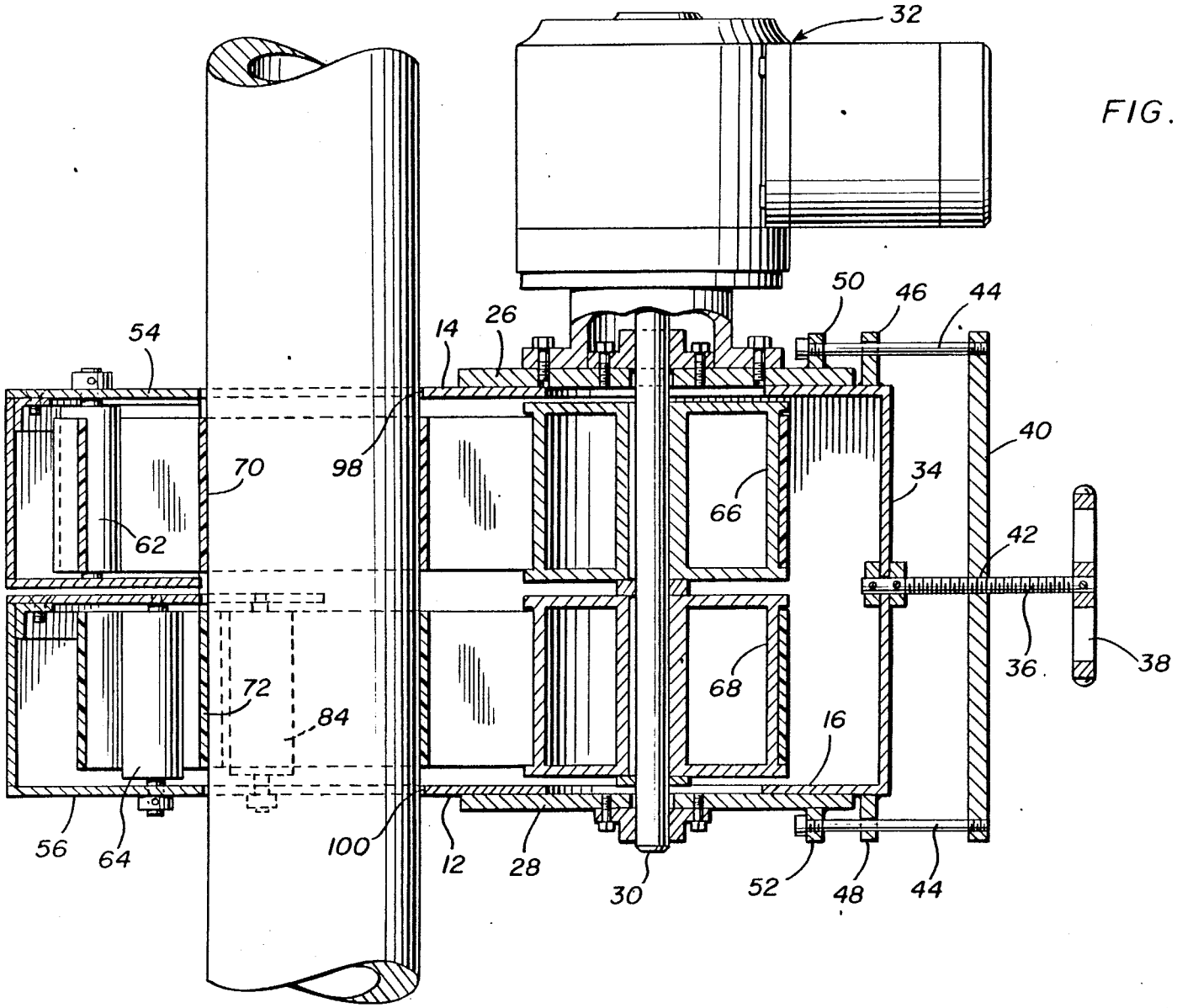
FIG. 3 is an enlarged vertical sectional view taken substantially upon the plane indicated by the section line 3—3 of FIG. 1.

In FIG. 5 of the drawings, there is illustrated a modified form tool referred to in general by the reference number 10', the 10' including only a single door 56' corresponding to the door 56 and a single torque transfer belt 72' corresponding to the belt 72. However, it will be noted that the bight 80' of the belt 72' engaged with the section 24 extends about the latter even more than 270° and in fact that bight 80' extends generally 325° about the outer periphery of the section 24. The tool 10' illustrated in FIG. 5 may be used to advantage in situations where maximum torque transfer is not required, even though the 325° angular extent of the inverse bight 72' extending about the section 24 is capable of transfering considerable rotary torque to the section 24.

Also, the tools 10 and 10' may be miniaturized and be powered by chain saw power heads and be utilized to thread and unthread adjacent pipe section ends disposed or to be placed within a ditch or any place pipe are to be joined together.

Further, hydraulic cylinders (not shown) may be mounted on opposite sides of the body 12 and connected to opposite side connecting structures (not shown) extending between the upper and lower mounting plates 26 and 28. Such cylinders may be remotely operated and used in lieu of the jack screw 36 and hand wheel 38 for adjusting the tension of the belts 70 and 72. Further, such cylinders may be anchored to the doors 54 and 56 and thereby used not only to tension the belts 70 and 72, but also to close the doors 54 and 56. Also, the belts 70 and 72 may comprise cog belts with the cogs thereof engaged between similar cogs provided on the drums 66 and 68 and the smooth sides of the belts frictionally engaged with the pipe section to be turned. Still further, a plurality of longitudinally staggered chains may be used in lieu of each of the belts 70 and 72 with each of the drive drums 66 and 68 being replaced with angularly staggered sprocket wheels about which the similarly staggered chains may be trained.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalent may be resorted to, falling within the scope of the invention.

What is claimed as new is as follows:

1. A turning tool for laterally engaging an elongated member intermediate its opposite ends and turning said elongated member about its longitudinal axis, said tool including a main body having a first end and a second end remote from said first end, said body being adapted to be shifted among a path extending between said ends toward and away from said elongated member with said second end facing away from said elongated member, said body also defining a pair of opposite sides extending between said ends, said first end including at least one elongated door including base and free ends, said base end being pivotally mounted from one side of said first end for swinging about a first axis between a closed position extending across said first end an open position extending outwardly from said first end, said first end defining a notch therein paralleling said first axis and opening endwise outwardly of said first end, driven drum means journalled from the second end of said body about a second axis paralleling said first axis, said body and door including strategically located rollers journalled therefrom about axes generally paralleling the said first axis and aligned with said drum means, an endless flexible drive member trained about said rollers and drum with said drive member including a positive bight extending about each of said rollers and said drum means, said drive member including a reach thereof extending between one of said rollers journalled from said body and a closely adjacent roller journalled from the free end of said door and deflectable inwardly of said notch into a negative bight for passing about said elongated member in friction driving engagement therewith, said negative bight opening in a direction inclined at least generally 45° relative to the direction in which said notch opens, and means operatively connected between said body and door to releasably retain said door in the closed position thereof, said body including a pair of said doors staggered relative to each other along the longitudinal extent of said notch and with the base ends of said doors pivotally mounted from opposite sides of said body, each of said doors including a pair of rollers journalled therefrom and the opposite sides of said first end of said housing each including a roller journalled therefrom, said drum means including axially spaced circumferential zones thereof registered with said doors and said tool including a pair of endless flexible drive members each trained about a corresponding drum circumferential zone and a corresponding pair of door rollers as well as one of the housing rollers, said drive members each including a negative bight of at least 270° and less than 360° in angular extent for frictionally drivingly engaging an equal angular extent of the outer periphery of said elongated member with said drive members engaged with axially circumferential zones of said elongated member.

2. The tool of claim 1 wherein said negative bights open outwardly along paths angularly displaced at least generally 90° relative to each other.

3. The tool of claim 4 wherein said pair of rollers journalled from each of said doors includes a first roller journalled from the base end thereof and a second roller journalled from the free end thereof and about which first and second positive bights of the corresponding endless drive member extend.

4. The tool of claim 3 wherein each roller supported from the open end of said body about which a positive bight of said drive members extends is disposed closely adjacent one of the corresponding door rollers carried by the free end of the associated door when the associated door is in the closed position.

5. A turning tool for laterally engaging an elongated member intermediate its opposite ends and turning said elongated member about its longitudinal axis, said tool including a main body having a first end and a second end remote from the first end, a first pair of opposite sides extending between said ends and a second pair of opposite sides extending between said ends with each side of said second pair of sides extending between a pair of corresponding marginal portions of said first pair of sides, said body being adapted to be shifted along a path extending between said ends toward and away from said elongated member to be engaged and turned and with said second end facing away from elongated member, said first end defining an outwardly opening notch extending between and opening at its opposite ends through said second pair of sides, powered drive drum means journalled from said second end of said body for rotation about an axis extending between said second pair of opposite sides and substantially paralleling the longitudinal extent of said notch, a first pair of guide rollers journalled from said body first end on opposite sides of said notch and generally paralleling said drum means, a pair of elongated end doors extending across said first end of said body and laterally spaced apart between said second pair of sides, alternate ends of said doors being pivotally mounted from said first pair of sides adjacent said first end of said body for swinging about axes paralleling said drum means between closed positions extending across said first end of said body and open positions extending outwardly from said first end, retaining means operative to releasably retain said door in the closed positions; the pivoted ends of said doors comprising the base ends thereof and the swinging ends of said doors comprising the free ends thereof, each of said doors including a roller journalled from the free swinging end thereof generally paralleling said drum means, said door mounted rollers and first pair of rollers being aligned with opposite end portions of said drum means, a pair of laterally spaced endless flexible drive members including positive bights passing about said opposite end portions of said drum means, the corresponding door mounted roller and the adjacent roller of said first pair of rollers, each of said drive members including a negative bight disposed within said notch and extending between the corresponding door mounted guide rollers and the adjacent roller of said first pair of rollers, said negative bights being adapted to frictionally drivingly engage axially spaced portions of said elongated member disposed in and extending through said notch when said doors are in the closed positions.

6. A turning tool for laterally engaging an elongated member intermediate its opposite ends and turning said elongated member about its longitudinal axis, said tool including a main body having a first end and a second end remote from the first end, a first pair of opposite sides extending between said ends and a second pair of opposite sides extending between said ends with each side of said second pair of sides extending between a pair of corresponding marginal portions of said first pair of sides, said body being adapted to be shifted along a path extending between said ends toward and away from said elongated member with said second end facing away from elongated member, said first end defining an outwardly opening notch extending between and opening at its opposite ends through said second sides, powered drive drum means journalled from said second end of said body for rotation about an axis extending between said second pair of opposite sides and substantially paralleling the longitudinal extent of said notch, a first pair of guide rollers journalled from said body first end on opposite sides of said notch and generally paralleling said drum means, a pair of elongated end doors extending across said first end of said body and laterally spaced apart between said second pair of sides, alternate ends of said doors being pivotally mounted from said first pair of sides adjacent said first end of said body for swinging about axes paralleling said drum means between closed positions extending across said first end of said body and open positions extending outwardly from said first end, retaining means operative to releasably retain said doors in the closed position, the pivoted ends of said doors comprising the base ends thereof and the swingable ends of said doors comprising the free ends thereof, each of said doors including a pair of guide rollers journalled from the base and free ends thereof generally paralleling said drum means, said door and guide rollers journalled therefrom being aligned with opposite end portions of said drum means, a pair of laterally spaced endless flexible drive members including positive bights passing about the opposite end portions of said drum means and the door mounted guide rollers aligned therewith, each of said drive members also including a positive bight passing about corresponding roller of said first pair of rollers, said drive members including negative disposed within said notch and between each of said first pair of rollers and the corresponding door free end roller, said negative bights being disposed for tight frictional driving engagement with axially spaced peripheral portions of said elongated member received within said notch inwardly of said doors when the latter are closed.

7. The turning tool of claim 6 including remotely operable means operatively connected between said doors and said body for swinging said doors between the open and closed positions thereof.

8. The turning tool of claim 6 wherein said drum means is journalled from said second end of said body for adjustable shifting longitudinally of said body.

9. The turning tool of claim 6 wherein each of said door free end rollers and the adjacent roller of said first pair rollers are closely spaced apart when said doors are in the closed positions.

10. The turning tool of claim 9 wherein said drum means is journalled from said body for adjustable shifting of the axis of rotation thereof toward and away from said first body end.

* * * * *